US007698827B2

(12) United States Patent
Lee et al.

(10) Patent No.: US 7,698,827 B2
(45) Date of Patent: Apr. 20, 2010

(54) BEVEL SETTER

(75) Inventors: Robin C. Lee, Nepean (CA); John S. Pratt, Atlanta, GA (US); Scott T. Roger, Ottawa (CA)

(73) Assignee: Lee Valley Tools, Ltd., Ottawa, ON (CA)

( * ) Notice: Subject to any disclaimer, the term of this patent is extended or adjusted under 35 U.S.C. 154(b) by 417 days.

(21) Appl. No.: 11/516,130

(22) Filed: Sep. 5, 2006

(65) Prior Publication Data

US 2007/0056175 A1 Mar. 15, 2007

(51) Int. Cl.
*B43L 7/10* (2006.01)

(52) U.S. Cl. ..... 33/471; 33/473; 33/419; 33/451

(58) Field of Classification Search ..... 33/471, 33/473–474, 455, 452, 464, 465, 470, 483–484, 33/494–500, 419
See application file for complete search history.

(56) References Cited

U.S. PATENT DOCUMENTS

| | | | |
|---|---|---|---|
| 237,202 | A | 2/1881 | Parker |
| 345,196 | A | 7/1886 | Vose |
| 360,213 | A | 3/1887 | Farrell |
| 396,781 | A | 1/1889 | Talmadge |
| 409,414 | A | 8/1889 | Meek |
| 434,073 | A | 8/1890 | Rondinella |
| 663,168 | A | 12/1900 | Hembree |
| 697,701 | A | 4/1902 | Ayer |
| 708,533 | A | 9/1902 | Cullmann |
| 728,558 | A | 5/1903 | Eldridge |
| 872,445 | A | 12/1907 | Olson et al. |
| 1,009,214 | A | 11/1911 | Backstrom |
| 1,050,969 | A | 1/1913 | McLeod |
| 1,091,332 | A | 3/1914 | Hart |
| 1,099,567 | A | 6/1914 | Neukirchen |
| 1,155,715 | A | 10/1915 | Faust |
| 1,189,983 | A | 7/1916 | McLeod |
| 1,266,845 | A | 4/1918 | Morin |
| 1,348,861 | A | 8/1920 | Frye, Jr |
| 1,389,486 | A | 8/1921 | Brewer |

(Continued)

FOREIGN PATENT DOCUMENTS

| | | |
|---|---|---|
| DE | 3811861 | 11/1988 |

(Continued)

OTHER PUBLICATIONS

"Bevel Boss," Sutherland Tool, Inc., www.sutherlandtool.com, printed May 4, 2007.

(Continued)

*Primary Examiner*—Yaritza Guadalupe-McCall
(74) *Attorney, Agent, or Firm*—Kilpatrick Stockton LLP; John S. Pratt; Camilla C. Williams

(57) ABSTRACT

A bevel setting tool having a rectangular plate, both sides of which are marked with reference indicia and a moveable fence that slides longitudinally on a stud that passes from the fence through a slot centrally located in the plate and into a locking knob. The fence and knob may be disassembled so that the fence can be positioned on either side of the plate.

9 Claims, 4 Drawing Sheets

U.S. PATENT DOCUMENTS

| | | | | | |
|---|---|---|---|---|---|
| 1,426,658 | A | | 8/1922 | McGuckin | |
| 1,488,875 | A | | 4/1924 | Franklin et al. | |
| 1,539,912 | A | | 6/1925 | Peterson | |
| 1,624,150 | A | | 4/1927 | Scherer | |
| 1,672,695 | A | | 6/1928 | Simpson | |
| 1,972,759 | A | | 9/1934 | Bumette | |
| 1,994,023 | A | * | 3/1935 | Koelman | 33/473 |
| 2,247,362 | A | | 7/1941 | Dibble, Jr. | |
| 2,400,407 | A | | 5/1946 | Gordon | |
| 2,438,337 | A | | 3/1948 | Gordon | |
| 2,505,437 | A | | 4/1950 | Skolnick | |
| 2,519,699 | A | | 8/1950 | Peterson | |
| 2,593,914 | A | | 4/1952 | Palitto | |
| 2,637,110 | A | | 5/1953 | Gilbertson | |
| 2,656,609 | A | | 10/1953 | Siggson | |
| 2,823,461 | A | | 2/1958 | Schneider | |
| 2,913,830 | A | | 11/1959 | Schroter | |
| 2,959,861 | A | | 11/1960 | Stromquist | |
| 2,981,005 | A | | 4/1961 | Moc | |
| 3,197,872 | A | | 8/1965 | Johnson | |
| 3,456,353 | A | * | 7/1969 | Iams | 33/429 |
| 4,185,391 | A | | 1/1980 | Roley | |
| 4,584,774 | A | | 4/1986 | Link | |
| 4,715,127 | A | * | 12/1987 | Bernabeu | 33/494 |
| 4,761,890 | A | * | 8/1988 | Morrell | 33/473 |
| 4,779,354 | A | | 10/1988 | Hill | |
| 4,843,728 | A | | 7/1989 | Francis | |
| D308,831 | S | | 6/1990 | MacLean | |
| 4,930,227 | A | * | 6/1990 | Ketchpel | 33/755 |
| 4,976,037 | A | | 12/1990 | Hines | |
| 5,253,426 | A | * | 10/1993 | Mosbrucker | 33/429 |
| 5,440,818 | A | | 8/1995 | Mailhot | |
| 5,446,969 | A | | 9/1995 | Terenzoni | |
| 5,915,806 | A | | 6/1999 | Levee | |
| 6,049,990 | A | * | 4/2000 | Holland | 33/464 |
| 6,167,628 | B1 | | 1/2001 | Jones et al. | |
| 6,260,283 | B1 | * | 7/2001 | Abernathy et al. | 33/419 |
| 6,928,744 | B2 | * | 8/2005 | Schweighoffer et al. | 33/755 |
| 7,159,328 | B1 | * | 1/2007 | Duda | 33/647 |
| 7,243,436 | B2 | * | 7/2007 | Casner et al. | 33/473 |
| 7,299,560 | B2 | * | 11/2007 | Diaz et al. | 33/471 |
| 2007/0240321 | A1 | * | 10/2007 | Shapiro | 33/471 |

FOREIGN PATENT DOCUMENTS

| | | | |
|---|---|---|---|
| DE | 4244533 | A1 | 5/1993 |
| EP | 0311710 | A1 | 4/1989 |
| GB | 267740 | | 3/1927 |
| GB | 2155407 | | 9/1985 |

OTHER PUBLICATIONS

Starrett, Double Squares, Mar. 1970, p. 165.
Lee Valley Fine Woodworking Tools catalog, 1987, p. 146.
P. 9, Item K, of the 1993/94 Lee Valley Catalog.

* cited by examiner

BEVEL SETTER

FIELD OF THE INVENTION

This invention relates to protractors, bevel gauges, and other tools used for setting and determining angles, particularly in woodworking.

BACKGROUND OF THE INVENTION

It is often necessary to mark and transfer an angle when doing woodworking and similar processes. The conventional tool for transferring an angle is a sliding bevel. While this tool is quite useful in transferring an angle from one work piece to another, problems are often encountered when trying to transfer an angle from a work piece to a typical woodworking power tool such as a table saw, where angles are set by reference to scales graduated in degrees. Often there is not enough registration space on the saw or other tool to allow a sliding bevel to be used accurately. It is also often necessary to lay out a specific angle for items such as dovetail joints. A typical sliding bevel is useful for this process; however, sliding bevels rarely have angular graduations and those that do make it difficult to accurately set angles by reference to the graduations.

Homemade and commercially available angle setting reference tools such as one marketed under the name "Bevel Boss" have long been available, but these tools are relatively large, can be somewhat difficult to use, and can rarely be used successfully to directly establish or mark an angle on a work piece.

Accordingly, there is a need for a compact tool capable of establishing a wide range of angles with significant accuracy and that can be used for directly transferring an angle to or establishing an angle on a work piece.

SUMMARY OF THE INVENTION

The bevel setting tool of this invention includes a rectangular plate, both sides of which are marked with reference indicia. A moveable fence slides longitudinally along a centrally located slot and includes a locking knob with a threaded stud that passes through the slot so that the fence can be locked in any position on the plate to which it can be moved. The fence and knob may be disassembled so that the fence can be positioned on either side of the plate. Alternatively, fences can be positioned on both sides of the plate attached to each other by a threaded stud within the central slot, making it possible to establish a reference surface on either side of the plate without any disassembly and reassembly of components. The fence faces may be highly polished so that reflections of the plate indicia in the face will facilitate positioning the fence. Friction-increasing polymeric film may also be positioned on the plate contact surface of the fence to facilitate accurate positioning of the fence on the plate.

The plate may also include one or more rulers as well as angular graduations.

In order to tell what angle a sliding bevel is set at, typically after having set the bevel by reference to a work piece, the handle of the sliding bevel is positioned along one edge of the bevel setter plate, and is slid until the blade aligns with an angular graduation, which can be read by the user.

In order to set a sliding bevel gauge at a specific angle, the fence is positioned on the plate by reference to the appropriate angular graduation, and locked in position. The sliding bevel blade is then set against the fence with the bevel handle against the edge of the plate, and the blade is locked into position.

This bevel setter can also be used to mark angles directly by placing the fence against the edge of a work piece and marking along an edge of the plate.

DETAILED DESCRIPTION

Figure 1:
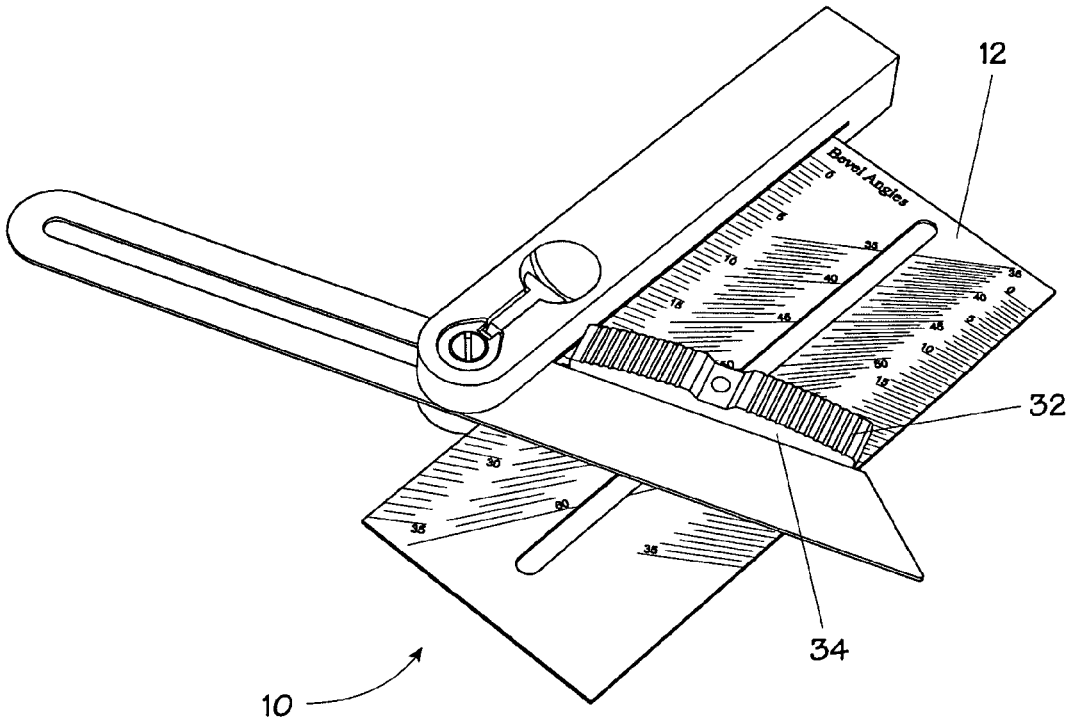
FIG. 1 is an isometric view of the bevel setter of this invention shown in use together with a sliding bevel gauge.
Figure 2:
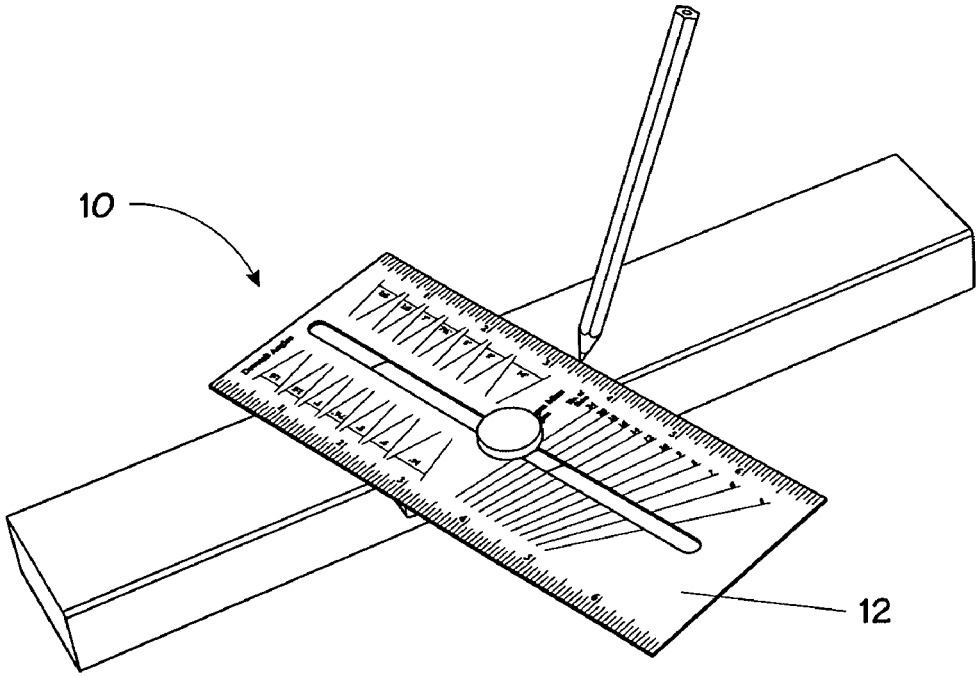
FIG. 2 is an isometric view of the bevel setter of FIG. 1 shown positioned for marking a desired angle on a work piece.
Figure 3:
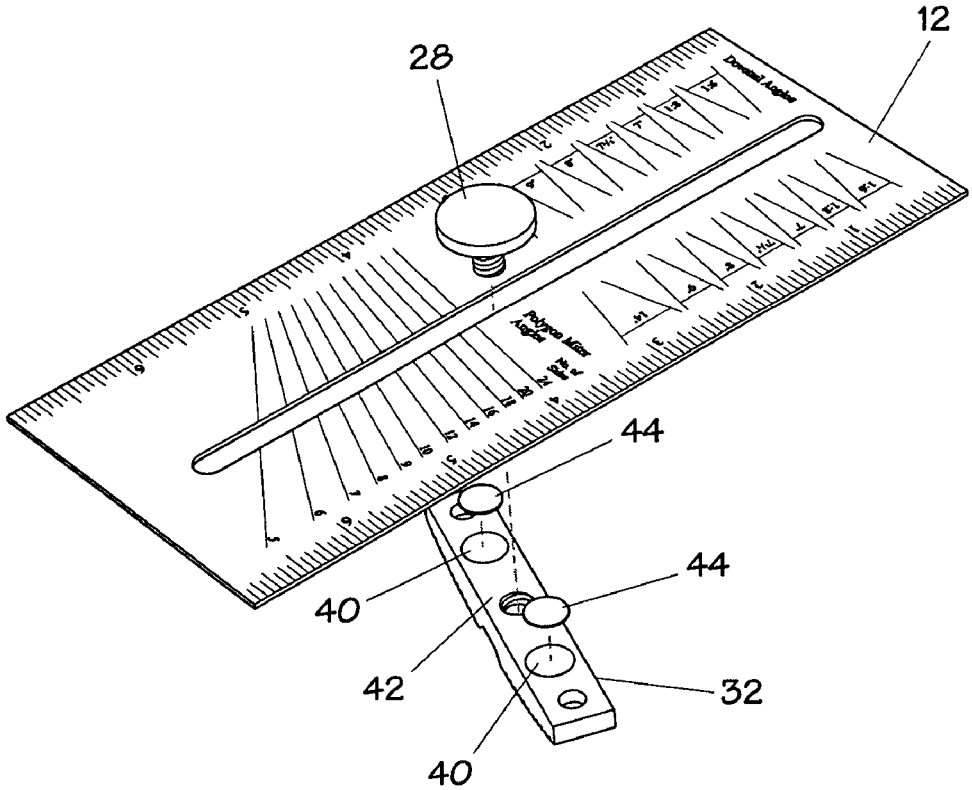
FIG. 3 is an exploded perspective view of the bevel setter shown in FIG. 1.

An illustrative embodiment of this invention is shown in the drawings as bevel setter 10, which utilizes a rectangular plate 12 penetrated by a centrally located slot 14 and marked with indicia 16 on the front face 18 of the plate 12 and indicia 20, 22 and 24 on the back face 26 of the plate 12. A knob or thumb screw 28 positionable on one face of the plate 12 is connected by a threaded stud or screw shank 30 to a fence 32 positionable on the other face of the plate 12. Either or both of the fence 32 and knob 28 can be threaded to receive the stud or screw 30. The fence 32 may be made in a variety of shapes that will typically be as long as the plate 12 is wide and have faces 34 and 38 square to the plate 12 face 18 or 26 when the fence 32 is positioned on the plate 12. Fence faces 34 and 36 may be highly polished so that indicia on the plate are reflected in the face of the fence, which facilitates accurate positioning of the fence 32 relative to indicia 16, 20, 22 or 24 on the plate 12. Circular recesses 40 in the bottom 42 of fence 32 may receive disks 44 of friction-increasing materials such as high density urethane, which will improve the characteristics of contact between the fence and plate 12 and thereby facilitate positioning of the fence 32 on plate 12. (These disks 44 and the underside 42 of fence 32 are illustrated in FIG. 3.)

Figure 4:
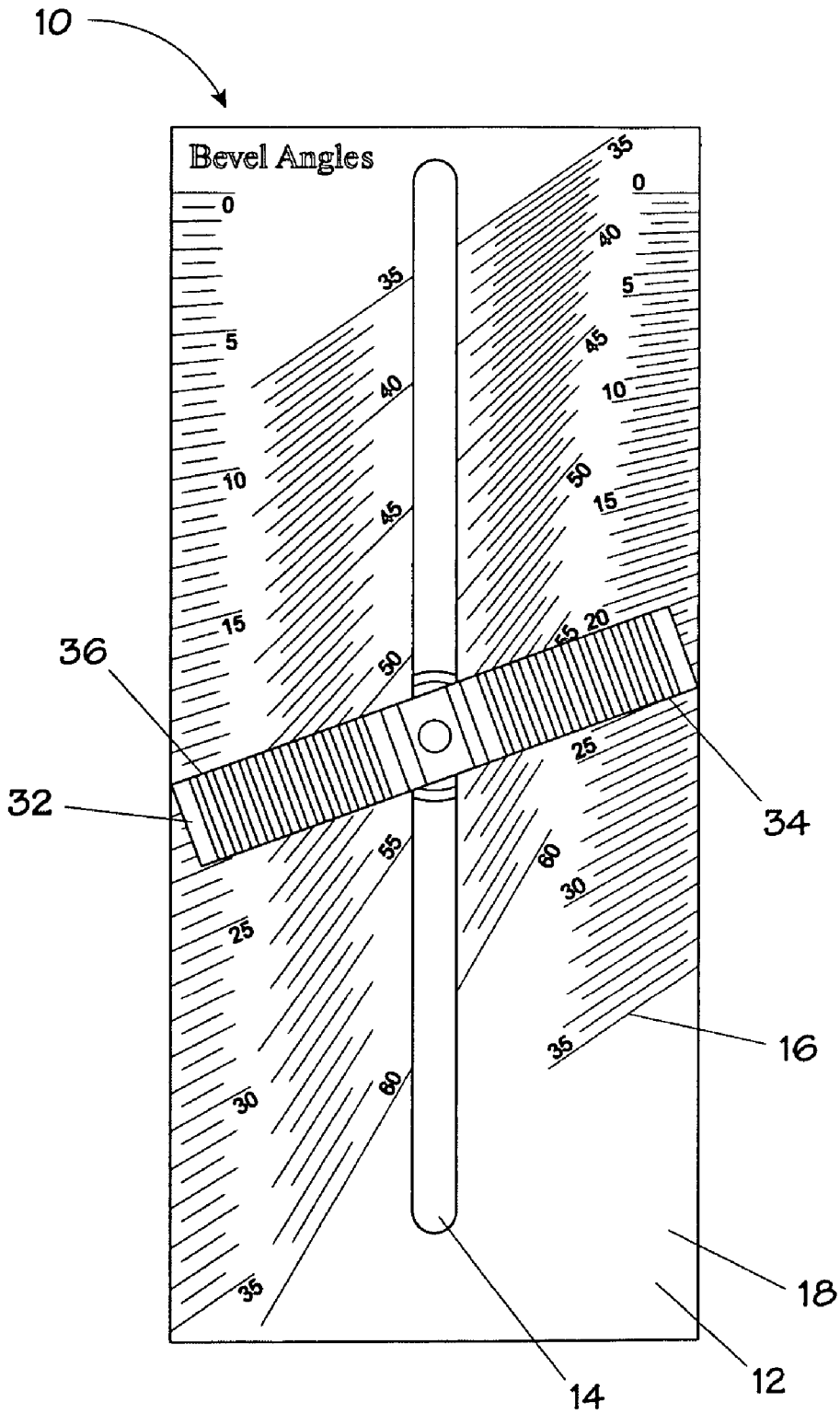
FIG. 4 is a top view of the bevel setter shown in FIG. 1.
Figure 5:
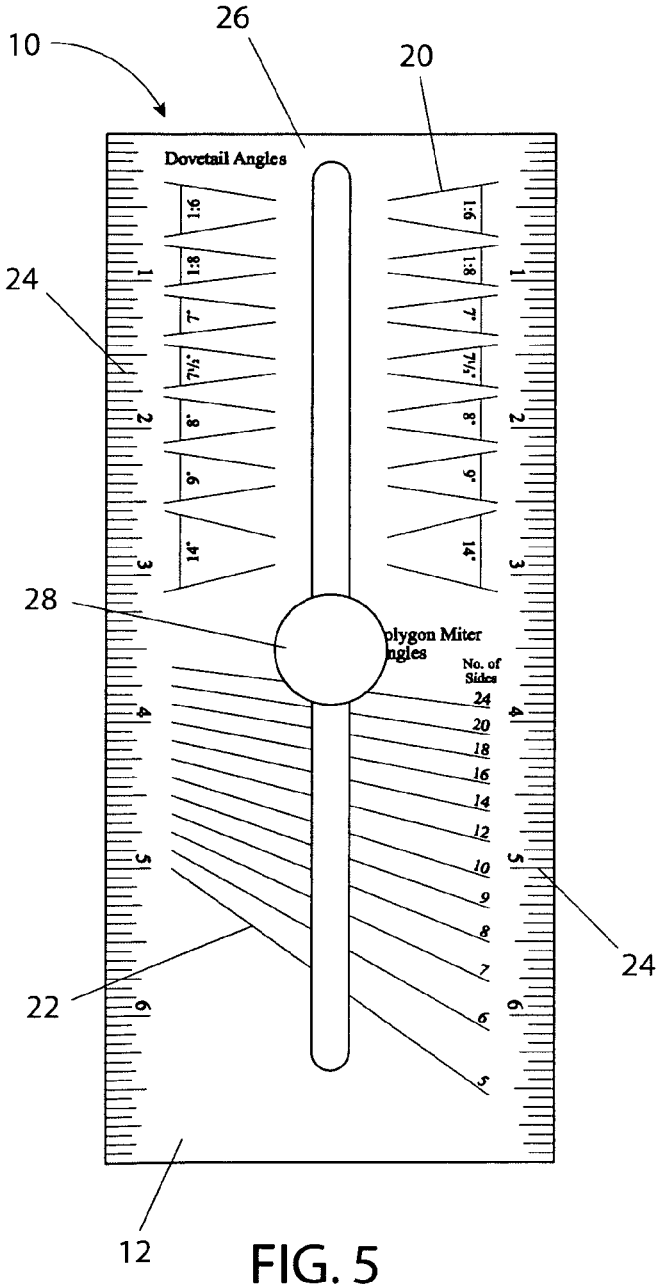
FIG. 5 is a bottom view of the bevel setter shown in FIG. 1.
Figure 6:
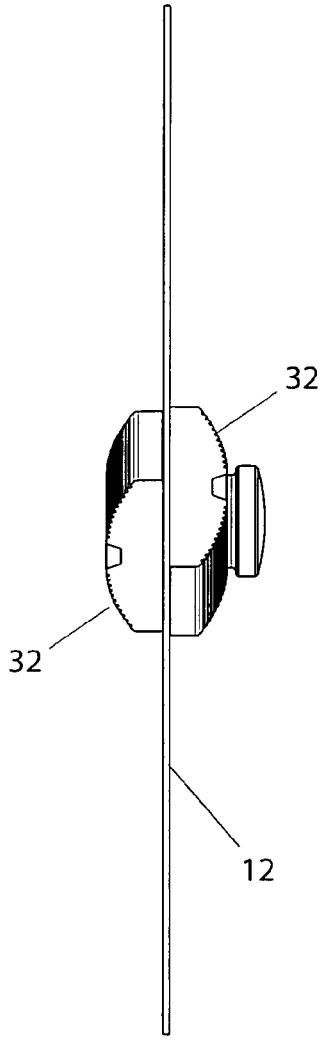
FIG. 6 is an edge view of an alternative embodiment of the bevel setter of this invention utilizing two fences.

As will be appreciated by reference to FIG. 4, bevel angles between 0° and 60° can be shown in indicia 16 by "folding" the scale positioning the markings at 2 pairs of distances from the slot 14. This makes it possible to provide a wide range of angular indicia on a relatively short plate 12. Other scale and indicia configurations are possible. As will be understood by reference to FIG. 5, one of the faces such as back face 26 of plate 12 can carry ruler indicia 24 along plate 12 edges, can be marked with commonly used dovetail angles such as indicia 20, and can be marked with the angles required in order to form polygons of various numbers of sizes such as indicia 22.

The plate 12 of this bevel setter can be made from stamped stainless steel; however, it can also be made of a wide variety of other appropriate materials including aluminum, brass and various plastics. The plate 12 can be manufactured using laser or water-jet cutting, casting, molding or machining. The indicia on the plate 12 may be chemically etched into the plate. Alternatively, they can be laser-etched, engraved, printed or stamped into the plate 12 surface. They also could be applied with a label, molded directly into the ruler component or made utilizing any other suitable manufacturing or marking technique.

Fence 32 can be made from a section of extruded aluminum or of any other suitably strong, stable and durable material, including brass, steel, various metal alloys, wood, plastics and plastic composite materials. As noted above, the side faces 34 and 36 of fence 32 can be polished so that they are reflective, which can facilitate accurate positioning of the fence 32 by reference to angular indicia 16, 22 or 26.

The layout of the angle indicia 16 are overlapped such that a full range of angles from 0° to 60° can fit into a relatively small space. Typically, angular markings radiate from a single point (either on the part, or off of the marked component). As a result, the parts must either be very large, or the markings must be very close together in order fit an appreciable range of angles on the part. In the bevel setter 10 of this invention, the angle range is split into two sets, 0° to 35° and 35° to 60°, and each set of angular indicia 16 radiates from a different center point. One set of angular markings 16 (0°-35°) has been marked along the outer edges of the plate 12. These 0°-35° graduations have been split in the middle, allowing space for the second set of graduations 16, 35°-60°. By placing the lower (0°-35°) angles on the outside edges of plate 12, and the higher angles (35°-60°) on the inside plate 12, each graduation can be quite long, increasing the ease and accuracy with which the fence 32 can be set, because there can be long registration between the indicia 16 line and fence face 34 or 36. As will be apparent from inspection of FIG. 4, there is no requirement that the range of angles marked by indicia 16 be split at 35 degrees; the split could happen at other places, and there is no requirement that the total indicia 16 range be 0-60 degrees; the range could start or end higher or lower.

As will be appreciated by reference to the preceding description and the accompanying drawings, numerous alternative configurations of components and different materials and indicia marking techniques can be used to practice this invention without departing from the spirit of the invention or the scope of the following claims. For instances materials not yet developed could be used rather than the exemplary materials described herein provided that such other materials have appropriate durability, rigidity and other physical properties appropriate for the bevel setter of this invention.

Similarly, modifications and additions in structure or configuration are possible without departing from the spirit of this invention or the scope of the following claims. For instance, the disks 44 positioned in the underside of fence 32 could be rare earth magnets that would secure the fence 32 in alternative desired positions on a plate 12 made of steel without necessarily requiring that the fence be mechanically locked in place using a threaded screw or stud 30 and a thumbscrew 28 or a second fence 32. Other means of locking the fence 32 in a desired position would also be possible, including arrangements for clamping the fence to the plate 12 near an edge of the plate 12 without use of any stud 30 or other structure passing through the plate 12, and therefore without any need for slot 14 in plate 12. The faces 34 and 36 also do not necessarily need to be parallel to each other; they might, for instance, lie at a typical dovetail angle relative to each other. As yet another alternative, two fences 32 might be locked on one face of plate 12 at different angles to make it possible rapidly to mark different angles on a work piece without stopping to change the fence setting. In yet another alternative, a second fence may be substituted for thumbscrew 28. Use of a second fence as a knob on the side opposite a user is reading avoids the need to switch the fence from front to back, thereby facilitating use of the tool.

The bevel setter of this invention is not confined to the embodiments described herein but includes variations and modifications within the scope and spirit of the foregoing description, the accompanying drawings and the following claims.

The invention claimed is:

1. A gauge, comprising:

a. a rectangular plate
   i. penetrated by a centrally located slot,
   ii. comprising at least one straight edge, and
   iii. marked with angular indicia, wherein
      1. each indicium comprises two aligned lines, one of which is on each of two sides of the slot,
      2. the angular indicia range between square to the straight edge and at least as few as 30 degrees relative to the straight edge, and
      3. the angular indicia comprise two nested ranges of angles, wherein
         a. a first of the two ranges of angular indicia comprises aligned indicium lines positioned
            i. at angles beginning square to the plate reference edge, and
            ii. further from the slot than the indicium lines of the second of the two ranges of angular indicia, and
         b. the second of the two ranges of angular indicia comprises angles relatively closer to 30 degrees to the plate reference edge than the first range, b. a metal fence having parallel faces that are square to a face of the plate when the fence is secured to the plate, and c. a threaded fastener for temporarily securing the fence to the plate in desired locations to position it at desired angles relative to the fence edges.

2. The gauge of claim 1, wherein the rectangular plate further comprises indicia of selected dovetail angles and selected polygon angles, and at least one of the fence faces reflects visual images.

3. The gauge of claim 2, wherein the indicia further comprise linear measure indicia.

4. The gauge of claim 2, wherein the plate is steel and the indicia are chemically etched into the plate.

5. The gauge of claim 2, wherein the angular indicia are positioned on each of two sides of the slot in two different ranges of angles.

6. The gauge of claim 1, wherein the threaded fastener is a thumbscrew having a knob that can be tightened against one face of the plate to cause the fence to tighten against the other face of the plate.

7. The gauge of claim 1, wherein the metal fence further comprises a length of extruded aluminum profile.

8. The gauge of claim 1, wherein the metal fence is metal injection molded.

9. The gauge of claim 1, wherein the metal fence is cast metal.

* * * * *